US010217413B2

(12) United States Patent
Lee et al.

(10) Patent No.: US 10,217,413 B2
(45) Date of Patent: Feb. 26, 2019

(54) ORGANIC LIGHT EMITTING DISPLAY (OLED) AND METHOD OF DRIVING THE SAME

(71) Applicant: LG DISPLAY CO., LTD., Seoul (KR)

(72) Inventors: Jeonga Lee, Seoul (KR); Suhyuk Jang, Paju-si (JP); Jiwoong Park, Goyang-si (KR); Seokjun Kang, Goyang-si (KR); Jinwon Lee, Paju-si (JP); Hyojin Kim, Paju-si (KR); Junhwan Park, Seosan-si (KR)

(73) Assignee: LG DISPLAY CO., LTD., Seoul (KR)

( * ) Notice: Subject to any disclaimer, the term of this patent is extended or adjusted under 35 U.S.C. 154(b) by 157 days.

(21) Appl. No.: 15/360,147

(22) Filed: Nov. 23, 2016

(65) Prior Publication Data

US 2017/0154577 A1 Jun. 1, 2017

(30) Foreign Application Priority Data

Nov. 26, 2015 (KR) ..... 10-2015-0166488

(51) Int. Cl.
*G09G 3/20* (2006.01)
*G09G 3/3233* (2016.01)
(Continued)

(52) U.S. Cl.
CPC ..... *G09G 3/3258* (2013.01); *G09G 3/3233* (2013.01); *G09G 3/3275* (2013.01); *G09G 3/2003* (2013.01); *G09G 2310/0248* (2013.01); *G09G 2310/0251* (2013.01); *G09G 2310/0297* (2013.01); *G09G 2320/0242* (2013.01); *G09G 2320/0295* (2013.01); *G09G 2320/043* (2013.01); *G09G 2320/045* (2013.01); *G09G 2330/028* (2013.01)

(58) Field of Classification Search
CPC .. G09G 3/3258; G09G 3/3233; G09G 3/3275; G09G 2310/0248; G09G 2310/0297; G09G 2320/043; G09G 2320/0295; G09G 2320/0242; G09G 2310/0251; G09G 2320/045; G09G 2330/028; G09G 3/2003; G09G 1/005
See application file for complete search history.

(56) References Cited

U.S. PATENT DOCUMENTS

2006/0132056 A1* 6/2006 Kim ..... G09G 3/3216 315/169.3
2006/0273998 A1* 12/2006 Young ..... G09G 3/3233 345/81
(Continued)

FOREIGN PATENT DOCUMENTS

CN 101477783 A 7/2009
CN 102074189 A 5/2011
(Continued)

*Primary Examiner* — Nitin Patel
*Assistant Examiner* — Amy Onyekaba
(74) *Attorney, Agent, or Firm* — Dentons US LLP

(57) ABSTRACT

Disclosed are an organic light emitting display and a method of driving the same. A charging circuit supplies charging voltages to organic light emitting diodes included in the plurality of subpixels, wherein a different charging voltage is supplied to at least one of the organic light emitting diodes. The data driver supplies data signals to data lines of the plurality of subpixels.

14 Claims, 15 Drawing Sheets

(51) Int. Cl.
*G09G 3/3258* (2016.01)
*G09G 3/3275* (2016.01)

(56) References Cited

U.S. PATENT DOCUMENTS

| | | | | |
|---|---|---|---|---|
| 2007/0040770 | A1* | 2/2007 | Kim | G09G 3/3233 345/76 |
| 2008/0001863 | A1* | 1/2008 | Kim | G09G 3/3208 345/82 |
| 2008/0012804 | A1* | 1/2008 | Kim | G09G 3/3233 345/82 |
| 2009/0174628 | A1* | 7/2009 | Wang | G09G 3/3225 345/76 |
| 2015/0179105 | A1* | 6/2015 | Mizukoshi | G09G 3/3266 345/76 |
| 2016/0012800 | A1* | 1/2016 | Han | G09G 3/3208 345/213 |
| 2016/0189624 | A1* | 6/2016 | Jang | G09G 3/3258 345/213 |
| 2017/0169767 | A1* | 6/2017 | Song | G09G 3/3291 |

FOREIGN PATENT DOCUMENTS

| | | | |
|---|---|---|---|
| CN | 104424893 | A | 3/2015 |
| CN | 104732916 | A | 6/2015 |
| CN | 104732920 | A | 6/2015 |
| JP | 2006133542 | A | 5/2006 |

* cited by examiner

ORGANIC LIGHT EMITTING DISPLAY (OLED) AND METHOD OF DRIVING THE SAME

This application claims the benefit of Korean Patent Application No. 10-2015-0166488, filed on Nov. 26, 2015, which is incorporated herein by reference for all purposes as if fully set forth herein.

BACKGROUND OF THE INVENTION

Field of the Invention

The present disclosure relates to an Organic Light Emitting Display (OLED), and a method of driving the same.

Discussion of Related Art

With the advancement of information technologies, there is increasing demand for display devices as a medium for a user to connect information. For example, an Organic Light Emitting Display (OLED) is widely used.

An OLED includes a display panel having a plurality of subpixels, a driver for outputting a driving signal to drive a display panel, and a power supply unit for generating power to be supplied to the driver. The driver includes a scan driver for supplying a scan signal (or a gate signal) to the display panel, and a data driver for supplying a data signal to the display panel. The OLED is able to display an image in a manner in which once driving signals, for example, a scan signal and a data signal, are supplied to the subpixels in the display panel, the selected subpixel emits light.

Such an OLED is typically desired to compensate a driving transistor and an organic light emitting diode included in the display panel (compensation for process variation and deterioration). For this reason, there has been a compensation method of sensing characteristics of the driving transistor and the organic light emitting diode and making compensation based on the sensed values.

Meanwhile, an organic light emitting diode shows different emission efficiency and deterioration speed (time) depending on the color emitted therefrom. However, the conventional method may not consider the emission efficiency and the deterioration speed depending on the color emitted from the organic light emitting diode, and thus, sensing and compensation may not be precisely performed.

SUMMARY

Accordingly, the present disclosure is directed to an Organic Light Emitting Display (OLED) and a method of driving the same that substantially obviate one or more problems due to limitations and disadvantages of the related art.

An advantage of the present disclosure is to provide an OLED with improved compensation for driving transistors and organic light emitting diodes.

Additional features and advantages of the present disclosure will be set forth in the description which follows, and in part will be apparent from the description, or may be learned by practice of the invention. These and other advantages of the present disclosure will be realized and attained by the structure particularly pointed out in the written description and claims hereof as well as the appended drawings.

In one general aspect, there is provided an Organic Light Emitting Display (OLED) including a plurality of subpixels, a charging circuit, and a data driver. The charging circuit supplies a charging voltage to organic light emitting diodes included in the plurality of subpixels, wherein a different charging voltage is supplied to at least one of the organic light emitting diodes. The data driver supplies a data signal to data lines of the plurality of subpixels.

In another general aspect, there is provided an Organic Light Emitting Display (OLED) including a plurality of subpixels, a sensing circuit, and a data driver. The sensing circuit senses a discharging voltage of organic light emitting diodes included in the plurality of subpixels, wherein a discharging voltage of at least one of the organic light emitting diodes is sensed for a different sensing time. The data driver supplies a data signal to data lines of the plurality of subpixels.

In yet another general aspect, there is provided a method of driving an Organic Light Emitting Display (OLED). The method includes supplying a charging voltage to organic light emitting diodes included in a plurality of subpixels, wherein a different charging voltage is supplied to at least one of the organic light emitting diodes, sensing the organic light emitting diodes during a period in which discharging voltages of the organic light emitting diodes come to converge, and generating a compensation value based on aging characteristics of the organic light emitting diodes.

In yet another general aspect, there is provided a method of driving an Organic Light Emitting Display (OLED). The method includes supplying a charging voltage to organic light emitting diodes included in a plurality of subpixels, sensing discharging voltages of the organic light emitting diodes, wherein a discharging voltage of at least one of the organic light emitting diodes is sensed for a different sensing time, and generating a compensation value based on aging characteristics of the organic light emitting diodes.

It is to be understood that both the foregoing general description and the following detailed description are exemplary and explanatory and are intended to provide further explanation of the invention as claimed.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention.

DESCRIPTION OF EXEMPLARY EMBODIMENTS

Reference will now be made in detail embodiments of the invention examples of which are illustrated in the accompanying drawings.

Hereinafter, the detailed embodiments of the present disclosure are described with the accompanying drawings.

An Organic Light Emitting Display (OLED) is implemented as a display panel in which one pixel unit consists of a red subpixel, a green subpixel, and a blue subpixel, or as a display panel in which one pixel unit consists of a red subpixel, a green subpixel, a blue subpixel, and a white subpixel. For convenience of explanation, there is hereinafter provided description based on the display panel in which one pixel unit consists of a red subpixel, a green subpixel, and a blue subpixel. In addition, a transistor described in the following may be referred to as a source electrode or a drain electrode, except for a gate electrode, according to a type thereof (N type or P type).

First Embodiment

Figure 1:
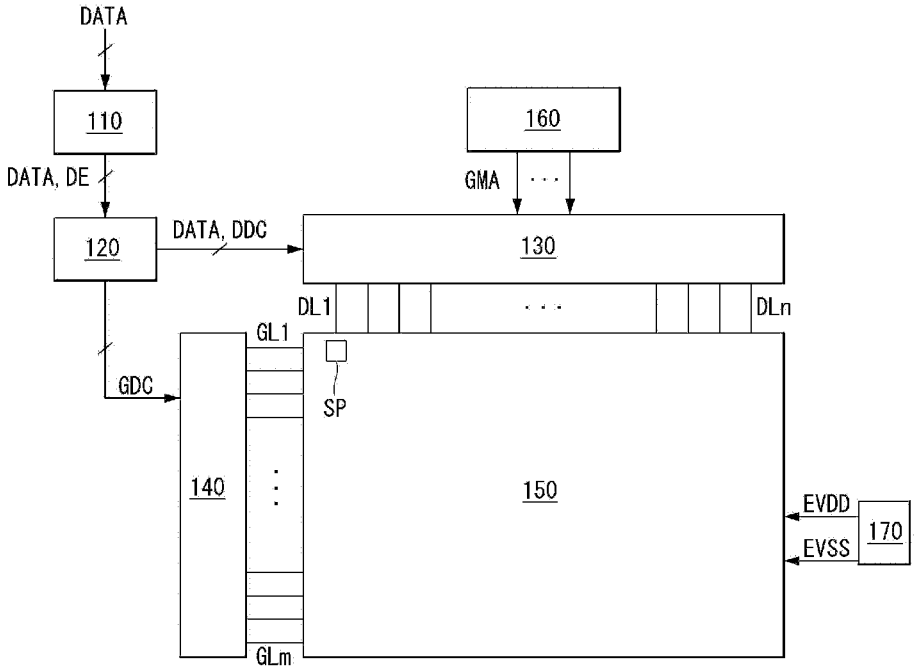
FIG. 1 is a block diagram illustrating an Organic Light Emitting Display (OLED) according to a first embodiment of the present disclosure.
Figure 2:
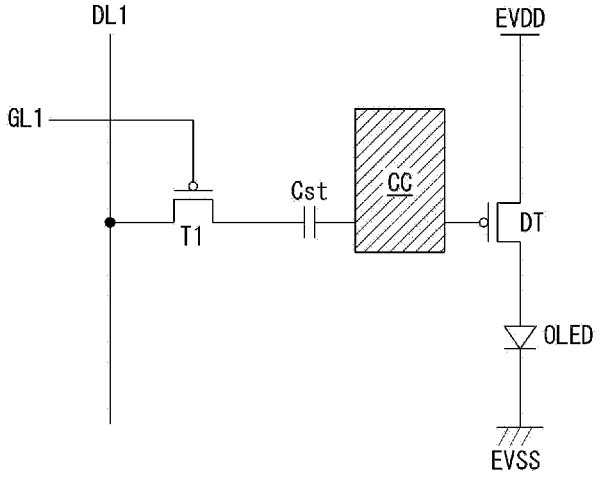
FIG. 2 is a diagram illustrating a subpixel shown in FIG. 1.
Figure 3:
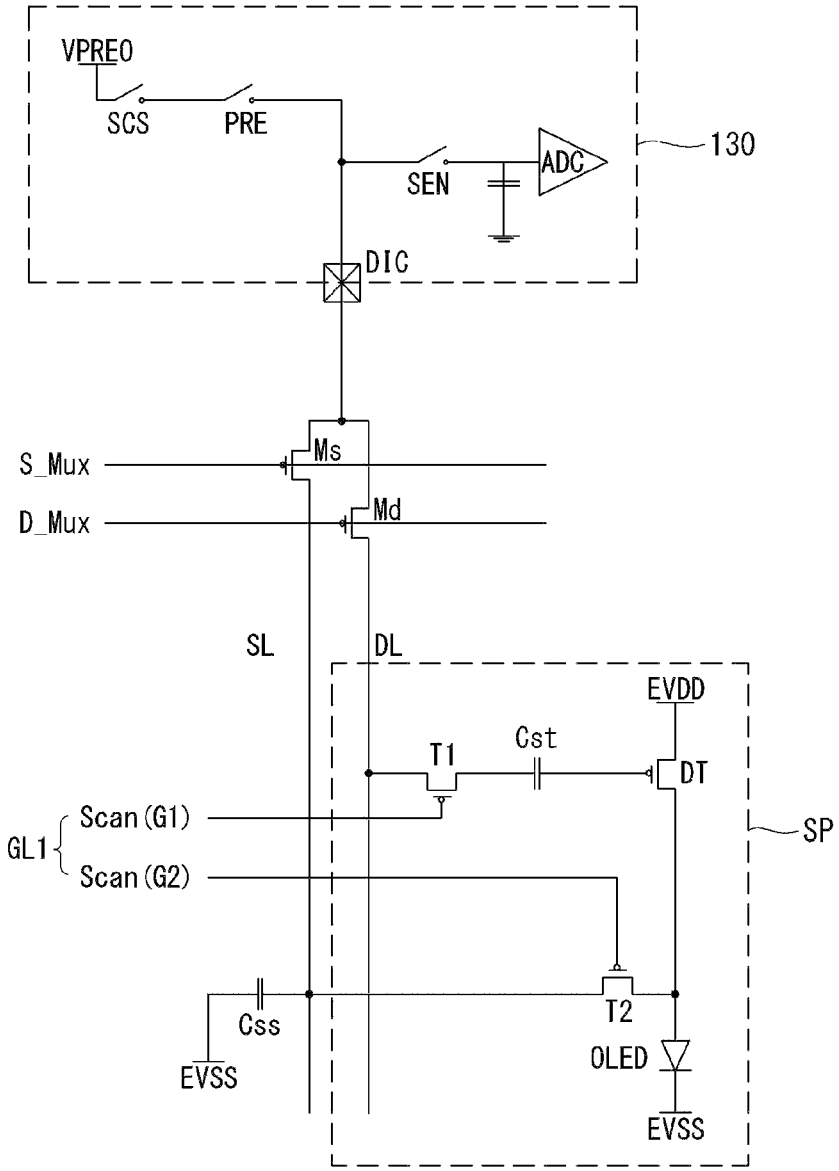
FIG. 3 is a circuit of a subpixel according to the first embodiment of the present disclosure.
Figure 4:
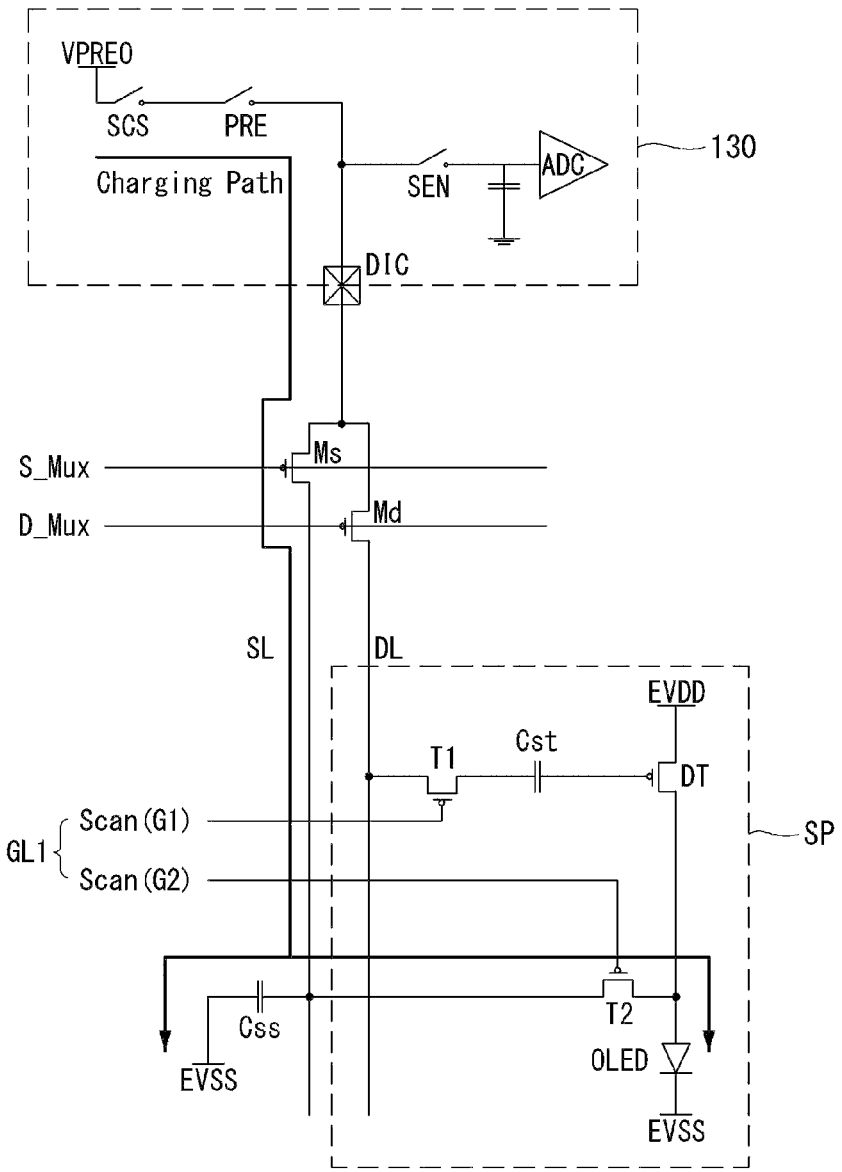
FIGS. 4 and 5 each is a circuit showing a charging/discharging path of a subpixel according to the first embodiment of the present disclosure.
Figure 5:
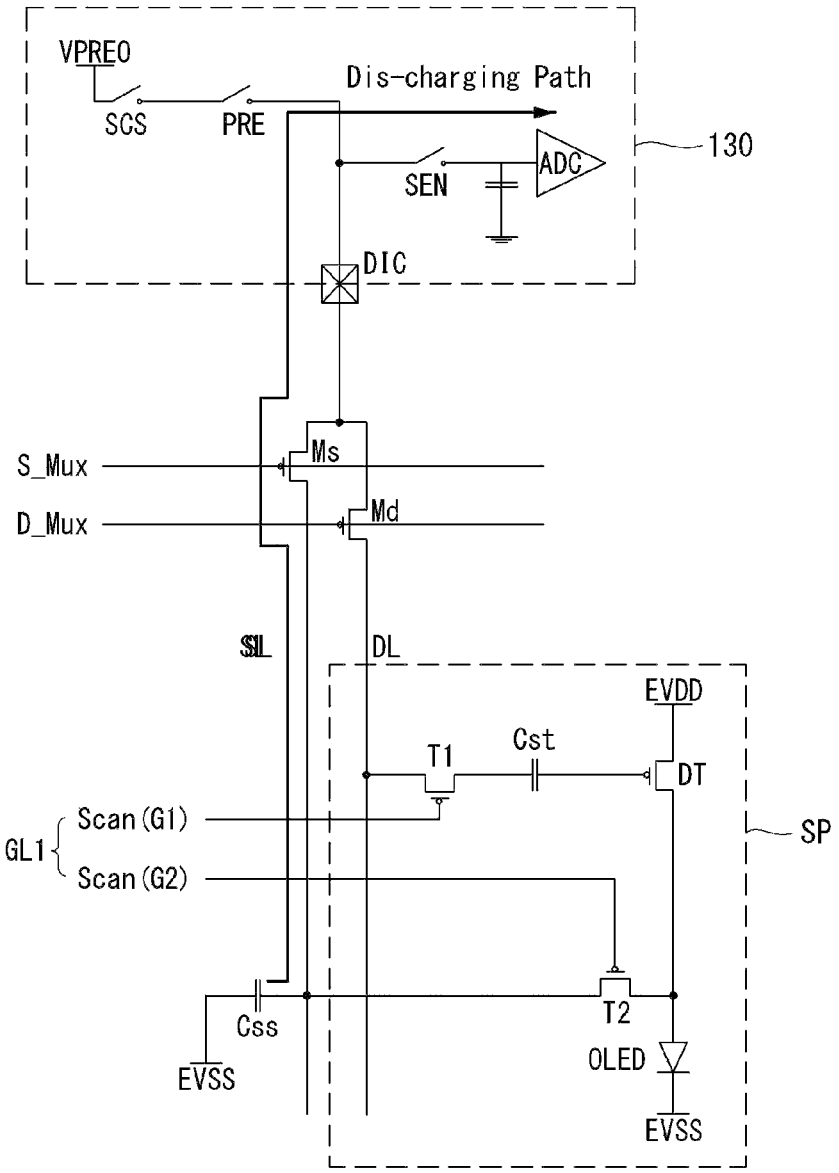
Figure 6:
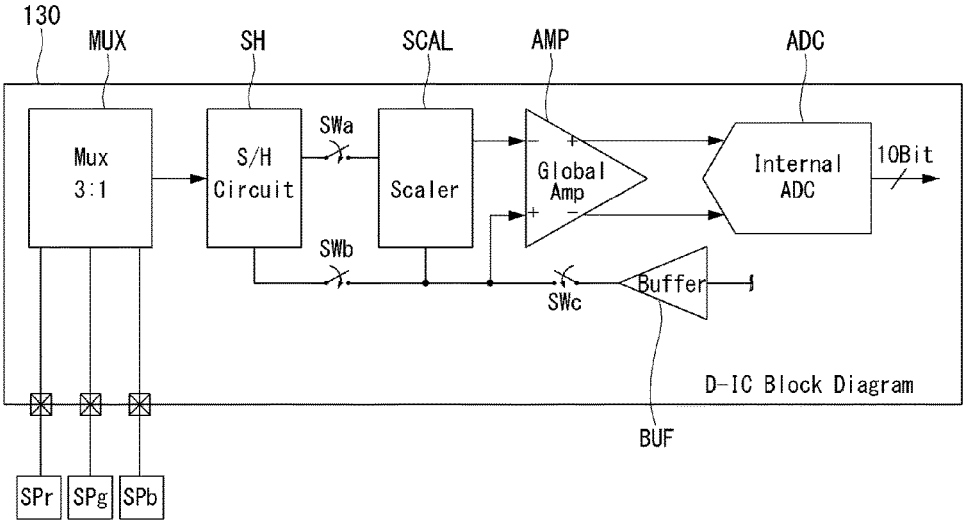
FIG. 6 is a block diagram illustrating a data driver according to the first embodiment of the present disclosure.

FIG. 1 is a block diagram illustrating an OLED according to a first embodiment of the present disclosure, FIG. 2 is a diagram illustrating a subpixel shown in FIG. 1, FIG. 3 is a circuit of a subpixel according to the first embodiment of the present disclosure, FIGS. 4 and 5 each is a circuit showing a charging/discharging path of a subpixel according to the first embodiment of the present disclosure; and FIG. 6 is a block diagram illustrating a data driver according to the first embodiment of the present disclosure.

As illustrated in FIG. 1, the OLED according to the first embodiment of the present disclosure includes an image supply unit 110, a timing controller 120, a scan driver 140, a data driver 130, a display panel 150, a programmable gamma unit 160, and a power supply unit 170.

The image supply unit 110 performs image processing on a data signal DATA, and outputs the resulting signal together with a vertical synchronization signal, a horizontal synchronization signal, a data enable signal, a clock signal, etc. The image supply unit 110 supplies the vertical synchronization signal, the horizontal synchronization signal, the data enable signal, the clock signal, and the data signal DATA to the timing controller 120.

The timing controller 120 is supplied with the data signal DATA and the like from the image supply unit 110, and outputs a gate timing control signal GDC for controlling an operation timing of the scan driver 140 and a data timing control signal DDC for controlling an operation timing of the data driver 130. The timing controller 120 supplies the data signal DATA along with the data timing control signal DDC to the data driver 130.

The scan driver 140 outputs a scan signal while shifting a level of a gate voltage in response to the gate timing control signal GDC supplied from the timing controller 120. The scan driver 140 supplies the scan signal to subpixels SP included in the display panel 150 through scan lines GL1 to GLm. The scan driver 140 may be formed as an integrated circuit (IC) type or as a Gate In Panel (GIP) type on the display panel 150.

The data driver 130 samples and latches a data signal DATA in response to a data timing control signal DDC supplied from the timing controller 120, and converts a digital signal into an analog signal in response to a gamma reference voltage, and outputs the analog signal. The data driver 130 supplies the data signal DATA to the subpixels SP included in the display panel 150 through data lines DL1 to DLn. The data driver 130 may be formed as an integrated circuit (IC) type.

The programmable gamma unit 160 outputs a gamma voltage GMA to be supplied to the data driver 130. The programmable gamma unit 160 varies (changes) the gamma voltage, which is to be output from itself, in response to a value set by a user, a developer, a manufacturer, or the like. For example, the programmable gamma unit 160 may vary a gamma voltage GMA into a specific voltage value under control of the timing controller 120, but aspects of the present disclosure are not limited thereto.

The power supply unit 170 generates and outputs power to be supplied to the timing controller 120, the scan driver 140, the data driver 130, and the display panel 150. However, the following description is about an example in which the power supply unit 170 generates and outputs first and second power voltages EVDD and EVSS to be supplied to the display panel 150.

The display panel 150 displays an image in response to a scan signal output from a driver including the scan driver 140 and the data driver 130 and the power EVDD and EVSS output from the power supply unit 170. The display panel 150 is implemented as a top-emission type, a bottom-emission type, or a dual-emission type. The display panel 150 includes subpixels SP that emit light or does not emit light in order to display an image.

As illustrated in FIG. 2, one subpixel is defined by a scan line GL1, a data line DL1, a first power line EVDD, and a second power line EVSS. Each subpixel may include a switching transistor T1, a capacitor Cst, a driving transistor DT, an organic light emitting diode, and a compensation circuit CC. The compensation circuit CC is provided to compensate for process variation or deterioration of the driving transistor DT and the organic light emitting diode included in the subpixel.

According to a configuration of the compensation circuit CC, the subpixel may have three transistors and one capacitor (3T1C), four transistors and two capacitors (4T2C), six transistors and one capacitor (6T1C), seven transistors and two capacitors (7T2C), or the like. In addition, according to a configuration of the compensation circuit CC, the sub pixel may include a first compensation circuit inside the subpixel and a second compensation circuit outside the subpixel. Hereinafter, the following description is about an example of a compensation circuit CC which includes the first compensation circuit and the second compensation circuit.

As illustrated in FIG. 3, one subpixel SP may include a first switching transistor T1, a first capacitor Cst, a second switching transistor T2, a driving transistor DT, and an organic light emitting diode.

The first switching transistor T1 transmits a data voltage Vdata, which is supplied from a N-th data line DL, to the capacitor Cst in response to a first scan signal. The first switching transistor T1 is configured such that a gate electrode thereof is connected to a first scan line G1, a first electrode thereof is connected to the N-th data line DL, and a second electrode thereof is connected to one end of the capacitor Cst.

The second switching transistor T2 electrically connects an anode electrode of the organic light emitting diode and a N-th sensing line SL in response to a second scan signal. The second switching transistor T2 is configured such that a gate electrode thereof is connected to a second scan line G2, a first electrode thereof is connected to the organic light emitting diode, and a second electrode thereof is connected to the N-th sensing line SL. The second switching transistor T2 may be driven in the need of sensing (electrical) characteristics of the organic light emitting diode.

In response to a data voltage Vdata stored in the capacitor Cst, the driving transistor DT generates a driving current that enables the organic light emitting diode to emit light. The driving transistor DT is configured such that a gate electrode thereof is connected to the other end of the capacitor Cst, a first electrode thereof is connected to a first power line EVDD, and a second electrode thereof is connected to a first electrode of the second switching transistor T2.

In response to a driving current generated by the driving transistor DT, the organic light emitting diode emits light in red, green, or blue. The organic light emitting diode is configured such that an anode electrode thereof is connected to a second electrode of the second switching transistor T2, and a cathode electrode thereof is connected to a second power line EVSS.

The first capacitor Cst stores a data voltage Vdata supplied through the N-th data line DL, and supplies the stored data voltage Vdata to the gate electrode of the driving transistor DT. The first capacitor Cst is configured such that one end thereof is connected to the second electrode of the first switching transistor T1, and the other end thereof is connected to the gate electrode of the driving transistor DT.

The aforementioned second switching transistor T2 is included in the first compensation circuit which is added inside the subpixel SP. The second compensation circuit, such as a first transistor Ms, a second transistor Md, and a second capacitor Css, is added outside the subpixel SP.

In response to a first selection signal, the first transistor Ms electrically connects a N-th th input/output channel of the data driver 130 to the N-th sensing line SL. The first transistor Ms is configured such that a gate electrode thereof is connected to a first selection signal line S_Mux, a first electrode thereof is connected to a N-th input/output channel of the data driver 130, and a second electrode thereof is connected to the N-th sensing line SL. The first transistor Ms may be driven in the need of sensing characteristics of the driving transistor DT or the organic light emitting diode during a sensing period.

In response to a second selection signal, the second transistor Md connects the N-th input/output channel of the data driver 130 and the N-th data line DL. The second transistor Md is configured such that a gate electrode thereof is connected to a second selection signal line D_Mux, a first electrode is connected to a N-th input/output channel of the data driver 130, and a second electrode thereof is connected to the N-th data line DL. The second transistor Md may be driven in the need of supplying a data voltage through the N-th data line DL.

The second capacitor Css stores and discharges a charging voltage. In response to a turning-on or turning-off operation of the first transistor Ms, the second capacitor Css may store or discharge the charging voltage. A path along which a charging voltage is stored in the second capacitor Css is the charging path shown in FIG. 4. A path along which the charging voltage stored in the second capacitor Css is discharged is a discharging path shown in FIG. 5.

According to the above description, the first compensation circuit T2 is added inside every subpixel. On the other hand, the second compensation circuits Ms, Md, and Css is provided as a group within a pair of a data line DL and a sensing line SL. The example shown in the drawings is about a case where the second compensation circuits are added outside a subpixel. However, at least one of (or selected from among) the second compensation circuits Ms, Md, and Css may be provided inside the data driver 130.

As illustrated in FIG. 6, a sensing circuit of the driving driver 130 includes a mux unit MUX, a sample holder SH, a scaler SCAL, an amplifier AMP, a buffer, BUF, switch units SWa to SWc, and an analog-digital converter ADC. The sensing circuit of the data driver 130 is configured to sense process variation and deterioration of the driving transistor DT and the organic light emitting diode included in the subpixel.

Besides the sensing circuit, a compensation value generation circuit for generating a compensation value based on a sensed value may exist inside the data driver 130. However, the compensation value generation circuit may be disposed in a timing controller, so a drawing and description of the compensation value generation circuit is omitted. Hereinafter, the configuration of the sensing circuit is described briefly.

The mux unit MUX selectively senses one of a red subpixel SPr, a green subpixel SPg, and a blue subpixel SPb. The sample holder SH samples a sensed value of the selected subpixel. The scaler SCAL scales the sampled value (e.g., up-scaling computation for improving accuracy and resolution of the sensed value).

The amplifier AMP amplifies a scaled sensed value and outputs the amplified value. The analog-digital converter ADC converts a sampled analog value into a digital value and outputs the digital value. The first to third switch units SWa to SWc perform a switching operation in response to an internal signal. The first to third switch units SWa to SWc controls operation of a circuit provided inside the data driver 130, such as the sample holder SH, the scaler SCAL, and the amplifier AMP.

As illustrated in FIGS. 3 to 6, the data driver 130 may drive a voltage output switches SCS and PRE, which are provided inside the data driver 130, to output a data voltage of a charging voltage (or a pre-charge voltage) through its N-th input/output channel. The voltage output switches SCS and PRE and a charge power source VPREO are included in a charge circuit of the data driver 130. The charge power source VPREO outputs a voltage, with or without varying the voltage, based on a voltage supplied from an external device (e.g., a power supply unit or a programmable gamma unit)

In addition, the data driver 130 may drive a voltage sensing switch SEN, which is included therein, to sense characteristics of the driving transistor DT and the organic light emitting diode through its N-th input/output channel. The voltage sensing switch SEN and the analog-digital converter ADC are included in the sensing circuit of the data driver 130.

Meanwhile, there is a conventional compensation method of sensing characteristics of a driving transistor and an organic light emitting diode and compensating for the sensed value. An organic light emitting diode has different emission efficiency and deterioration speed (time) based on a color emitted therefrom. However, the conventional method does not consider the emission efficiency and the deterioration speed based on colors emitted from the organic light emitting diodes, and thus, sensing and compensation are performed inaccurately.

Hereinafter, an experiment is conducted on an OLED implemented using the conventional compensation method, and the results are explored, as compared to an OLED implemented according to the first embodiment of the present disclosure.

First Experiment Example

Figure 7:
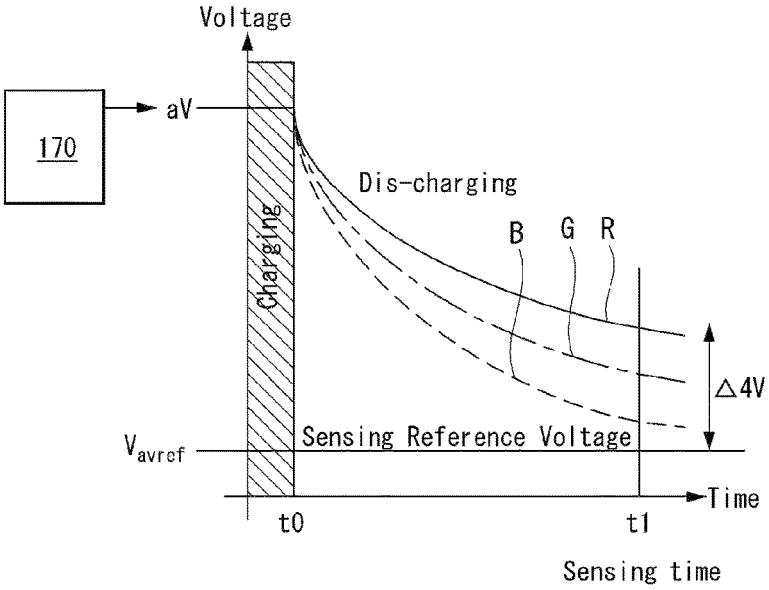
FIG. 7 is a charging/discharging curve graph for explanation of a problem of a sensing method according to a first experiment example.
Figure 8:
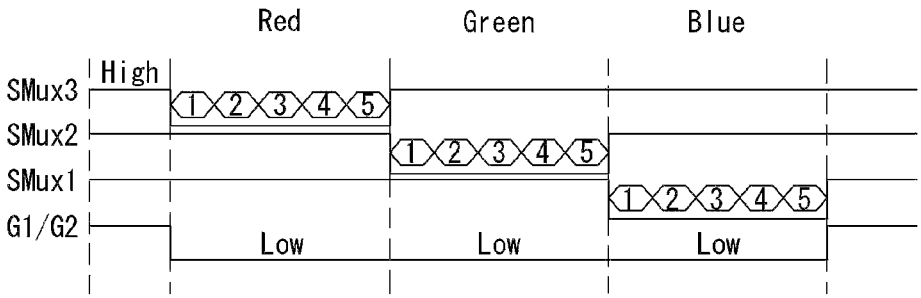
FIG. 8 is a sensing timing diagram for explanation of a sensing method according to the first experiment example.
Figure 9A:
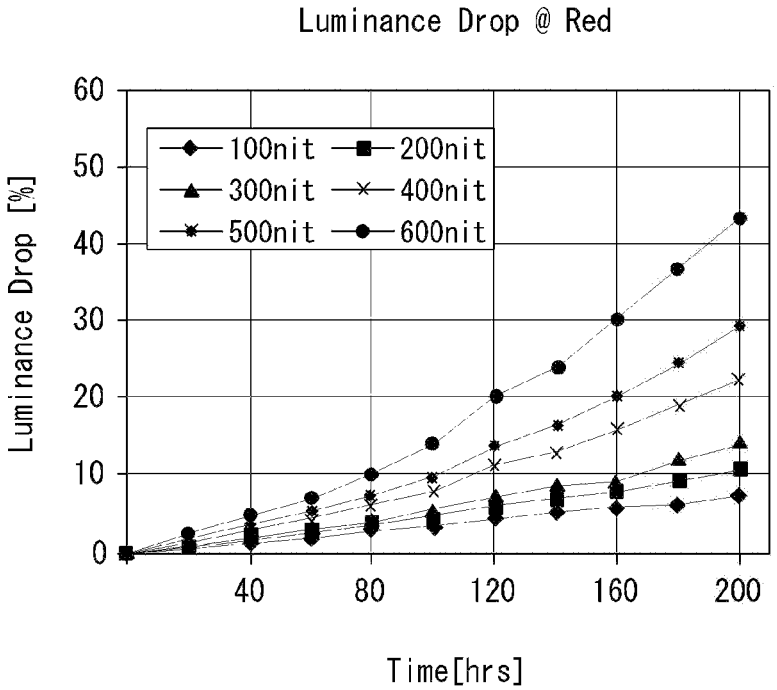
FIGS. 9A to 9C are graphs showing decrease in luminance based on colors emitted from organic light emitting diodes.
Figure 9B:
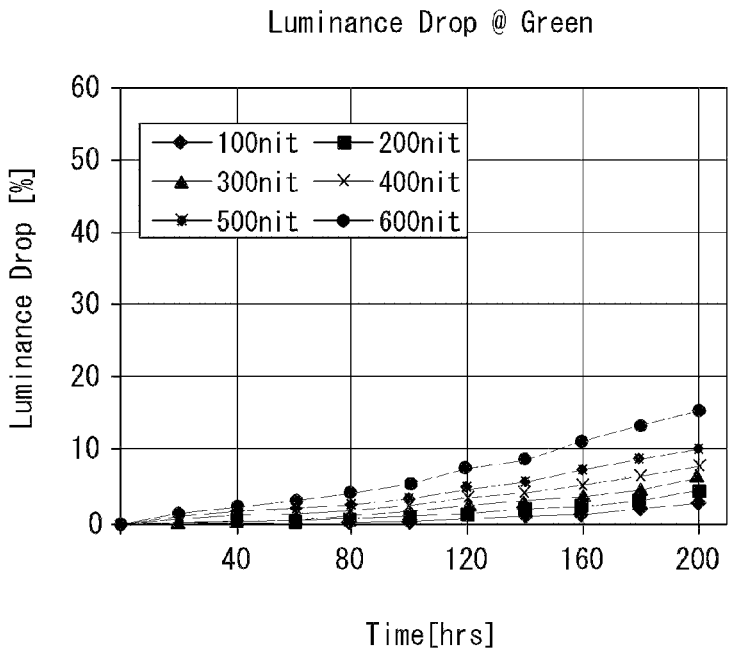
Figure 9C:
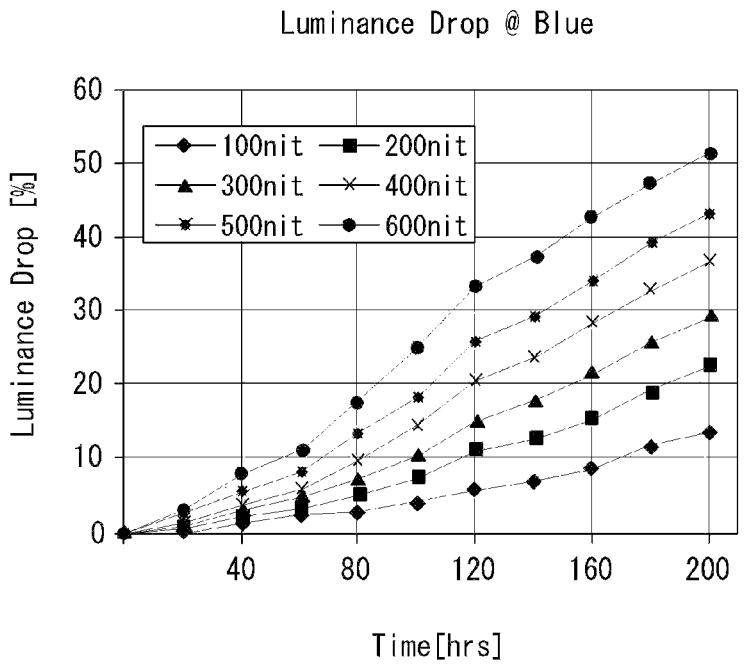
Figure 10:
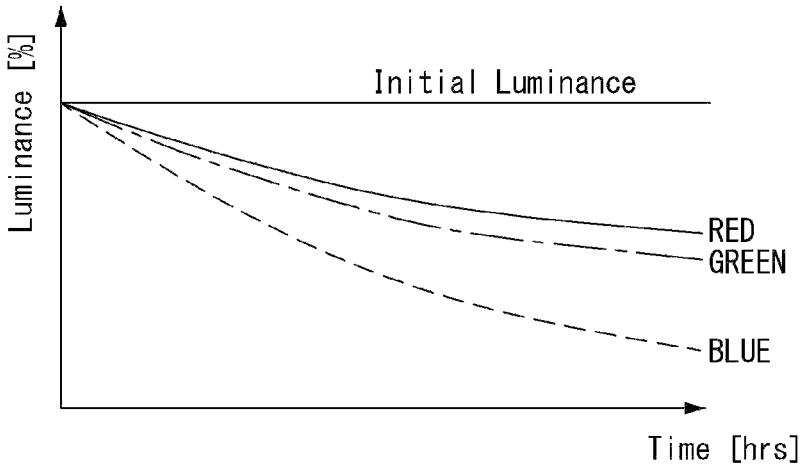
FIG. 10 is a graph showing life time of each color of an organic light emitting diode.

FIG. 7 is a charging/discharging curve graph for explanation of a problem of a sensing method according to a first experiment example, FIG. 8 is a sensing timing diagram for explanation of a sensing method according to the first experiment example, FIGS. 9A to 9C are graphs showing decrease in luminance based on colors emitted from organic light emitting diodes, and FIG. 10 is a graph showing life time of each color of an organic light emitting diode.

As illustrated in FIGS. 7 and 8, in the first experiment example, a charging voltage aV is applied for a predetermined time t0 in order to sense organic light emitting diodes. Then, when the organic light emitting diodes are discharging, the organic light emitting diodes are sensed with reference to a sensing reference voltage Vavref after a predetermined time t1 in accordance with an analog-to-digital conversion (ADC) scale. Accordingly, a data driver senses a degree of deterioration of an organic light emitting diode of each subpixel.

In the first experiment example, a single voltage output from a power supply unit is used as a charging voltage aV. The same charging voltage aV is supplied to a red organic light emitting diode (R), a green organic light emitting diode (G), and a blue organic light emitting diode (B). In this case, the ADC scale is provided in consideration of sensing variation of the red organic light emitting diode (R), the green organic light emitting diode (G), and the blue organic light emitting diode (B).

An organic light emitting diode has different emission efficiency due to luminance degraded based on a color emitted from the organic light emitting diode, as illustrated in FIGS. 9A to 9C. In addition, the organic light emitting diode has different deterioration speed based on a color emitted therefrom, as shown in FIG. 10. Therefore, the discharging curves of the red organic light emitting diode (R), the green organic light emitting diode (G), and the blue organic light emitting diode (B) become different over time (see Dis-charging graph with respect to R, G, and B in FIG. 7).

In the first experiment example, as shown in FIG. 7, the same charging voltage aV is supplied to all of the red organic light emitting diode (R), the green organic light emitting diode (G), and the blue organic light emitting diode (B). Thus, in the case of performing sensing after the predetermined time t1, the sensing range Δ4V with respect to the red organic light emitting diode (R), the green organic light emitting diode (G), and the blue organic light emitting diode (B) becomes wider. That is, because sensing is performed with reference to the same reference voltage Vavref in the first experiment example, the sensing range becomes wider and therefore the sensing accuracy is reduced (10 Bit Resolution, Δ4V:1 LSB=4 mV).

In addition, at a time when first and second scan signal G1 and G2 become logic low, sensing is continuously (or sequentially) performed on the red organic light emitting diode (R), the green organic light emitting diode (G), and the blue organic light emitting diode (B). Therefore, a long sensing time is beneficial in the first experiment example.

For example, a red organic light emitting diode included in a red subpixel is sensed if SMux3 signal drops from logic high to logic low, a green light emitting diode included in a green subpixel is sensed if SMux2 signal drops from logic high to logic low, and a blue light emitting diode included in a blue subpixel is sensed if SMux1 signal drops from logic high to logic low. In FIG. 5, each numeric value 1 to 5 indicates the number of times of sensing.

In the first experiment example, when sensing is performed using the same charging voltage aV, it is not possible to vary a voltage according to characteristics of an organic light emitting diode. In addition, as the same charging voltage aV is applied to a red light emitting diode (R), a green light emitting diode (G), and a blue light emitting diode (G) in the first experiment example, it is not possible to perform independent sensing of those organic light emitting diodes. Furthermore, as the same charging voltage aV is applied to the red light emitting diode (R), the green light emitting diode (G), and the blue light emitting diode (G), sensing accuracy is reduced and a long sensing time is beneficial.

First Embodiment

Figure 11:
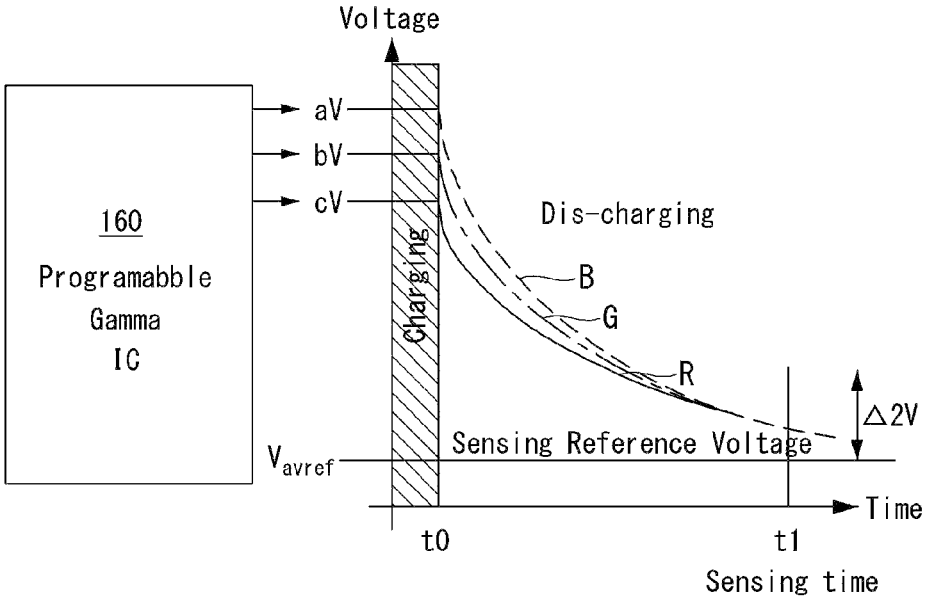
FIG. 11 is a charging/discharging curve graph for explanation of a sensing method according to the first embodiment of the present disclosure.
Figure 12:
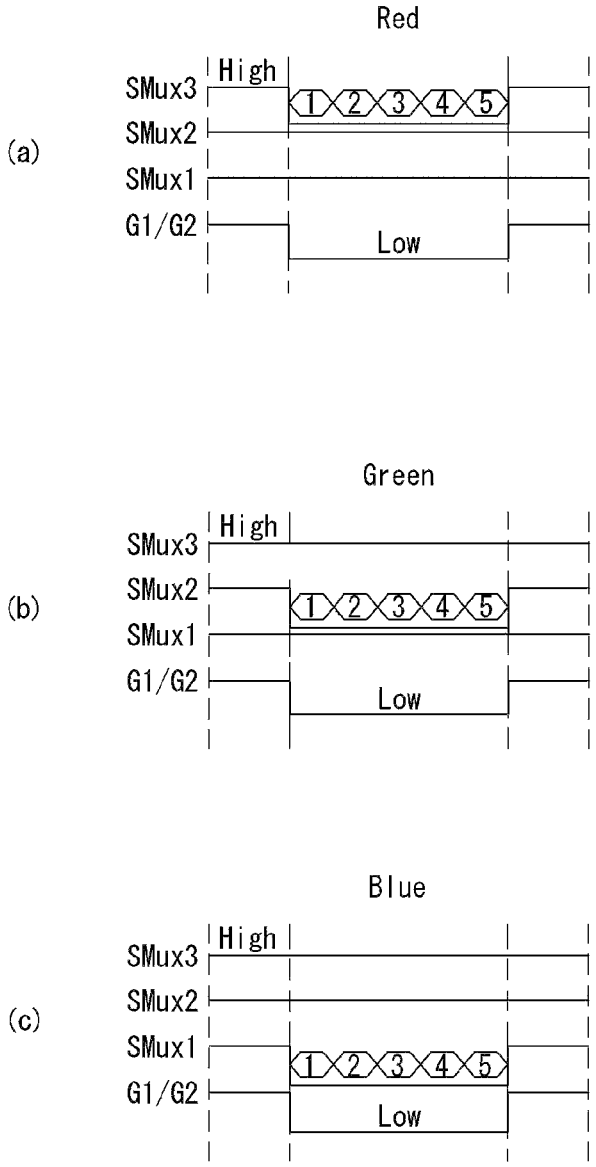
FIG. 12 is a diagram illustrating sensing timing for explanation of a sensing method according to the first embodiment of the present disclosure.
Figure 13:
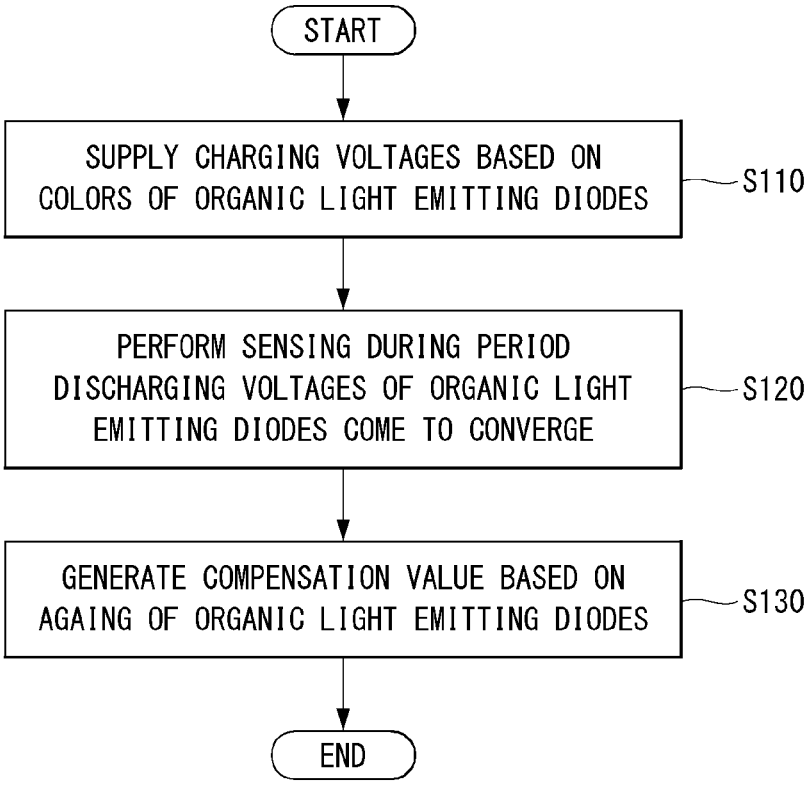
FIG. 13 is a flowchart illustrating a sensing method according to the first embodiment of the present disclosure.

FIG. 11 is a charging/discharging curve graph for explanation of a sensing method according to the first embodiment of the present disclosure, FIG. 12 is a diagram illustrating sensing timing for explanation of a sensing method according to the first embodiment of the present disclosure, and FIG. 13 is a flowchart illustrating a sensing method according to the first embodiment of the present disclosure.

As illustrated in FIGS. 11 to 13, a sensing method according to the present disclosure uses a different charging voltage based on aging characteristics of organic light emitting diodes.

The sensing method according to the first embodiment of the present disclosure includes supplying discharging voltages based on colors emitted from organic light emitting diodes in S110, sensing organic light emitting diodes during a period in which discharging voltages of the organic light emitting diodes come to converge in S120, and generating a compensation value based on aging of the organic light emitting diodes in S130.

In the first embodiment of the present disclosure, first to third charging voltages aV to cV are applied for a predetermined time t0 so as to sense organic light emitting diodes independently. Accordingly, a red organic light emitting diode (R), a green organic light emitting diode (G), and a blue organic light emitting diode (B) are supplied with different charging voltages based on a color emitted therefrom.

The red organic light emitting diode (R), the green organic light emitting diode (G), and the blue organic light emitting diode (B) have different discharging curves based on a color emitted therefrom. In the first embodiment of the present disclosure, after the predetermined time t1, a voltage output from a programmable gamma unit 160 may be used as a charging voltage to reduce a sensing range. However, aspects of the present disclosure are not limited thereto.

When the programmable gamma unit 160 is used, it is possible to vary a charging voltage to independently sense the red organic light emitting diode (R), the green organic light emitting diode (G), and the blue organic light emitting diode (B). However, aspects of the present disclosure are not limited thereto, and any device capable of varying a charging voltage may be used.

The levels of charging voltages may be in a relationship of the first charging voltage aV>the second charging voltage bV<the third charging voltage cV. The first charging voltage aV may be used for a blue organic light emitting diode, the second charging voltage vB may be used for a green organic light emitting diode, and the third charging voltage cV may be used for a red organic light emitting diode.

However, the above example is a case where each organic light emitting diode has different characteristics. Therefore, if two organic light emitting diodes have the same characteristics and only one organic light emitting diode has different characteristics, the levels of charging voltages may be in a relationship of the first charging voltage (aV)=the second charging voltage (bV)<the third charging voltage (cV) or in a relationship of the first charging voltage (aV)=the second charging voltage (bV)>the third charging voltage (cV).

In a case where an independent charging voltage is used just like the first embodiment of the present disclosure, discharging curves are formed in which the discharging voltages of the red organic light emitting diode (R), the green organic light emitting diode (G), and the blue organic light emitting diode (B) almost converge after the predetermined time t1. That is, dependent charging voltages are selected to enable the discharging voltages of the red organic light emitting diode (R), the green organic light emitting diode (G), and the blue organic light emitting diode (B) to converge after the predetermined time T1. Therefore, the time t1 or the vicinity thereof may be defined as a convergence period in which the discharging voltages of the red organic light emitting diode (R), the green organic light emitting diode (G), and the blue organic light emitting diode (B) all come to converge.

To allow the dependent charging voltages to converge for the same convergence period, preliminary experiments may be conducted to find out the respective discharging voltages of the red organic light emitting diode (R), the green organic light emitting diode (G), and the blue organic light emitting diode (B) and to make settings based on the found values. However, aspects of the present disclosure are not limited thereto.

In the first embodiment of the present disclosure, the independent charging voltages aV, bV, and cV are respectively supplied to the red red organic light emitting diode (R), the green organic light emitting diode (G), and the blue organic light emitting diode (B), as shown in FIG. 11. Therefore, if sensing is performed after the predetermined time t1, a sensing range Δ2V with respect to the red OLED (R), the green OLED (G), and the blue OLED (B) may be reduced. Since the sensing range is reduced, the sensing accuracy may improve in the first embodiment of the present disclosure (10 Bit Resolution, Δ2V:1LSB=2 mV).

In addition, in the first embodiment of the present disclosure, whenever the first and second scan signals G1 and G2 become logic low, the red organic light emitting diode (R), the green organic light emitting diode (G), and the blue organic light emitting diode (B) are independently (selectively) sensed. As such, it is possible to select a target to sense in the first embodiment of the present disclosure, and thus, a short sensing time is beneficial.

For example, a red organic light emitting diode included in a red subpixel is sensed if SMux3 drops from logic high to logic low, a green organic light emitting diode included in a green subpixel drops from logic high to logic low if SMux2 signal drops from logic high to logic low, and a blue organic light emitting diode included in a blue subpixel is sensed if SMux1 drops from logic high to logic low. In FIG. 10, each numeric value 1 to 5 indicates the number of times of sensing.

In the first embodiment of the present disclosure, organic light emitting diodes are sensed using independent charging voltages aV, bV, and cV based on colors emitted therefrom, and thus, it is possible to vary a voltage according to characteristics (e.g., aging characteristics) of each organic light emitting diode. In addition, as independent charging voltages aV, bV, and cV are respectively applied to a red organic light emitting diode (R), a green organic light emitting diode (G), and a blue organic light emitting diode (B), it is possible to independently sense the red organic light emitting diode (R), the green organic light emitting diode (G), and the blue organic light emitting diode (B). Furthermore, as the independent voltages aV, bV, and cV are applied to the red organic light emitting diode (R), the green organic light emitting diode (G), and the blue organic light emitting diode (B), sensing accuracy improves and a short sensing time is beneficial.

Meanwhile, the first embodiment of the present disclosure is about an example in which independent charging voltages are used to improve accuracy in sensing organic light emitting diodes. However, the following second embodiments may be used to improve the accuracy in sensing organic light emitting diodes.

Hereinafter, an experiment is conducted on an OLED implemented using the conventional compensation method based, and the results are explored, as compared to an OLED implemented according to the second embodiment of the present disclosure.

Second Experiment Example

Figure 14:
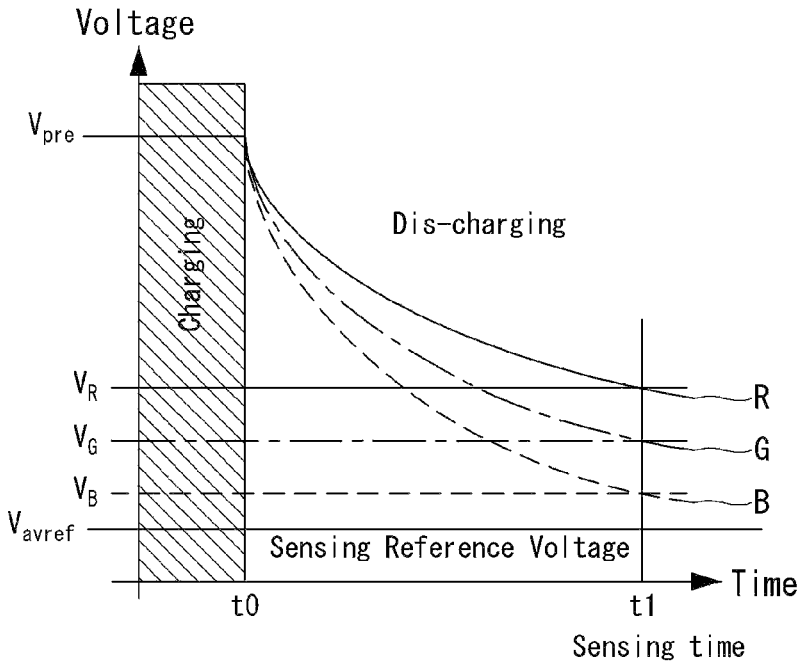
FIG. 14 is a charging/discharging curve graph for explanation of a problem of a sensing method according to the second experiment example.
Figure 15:
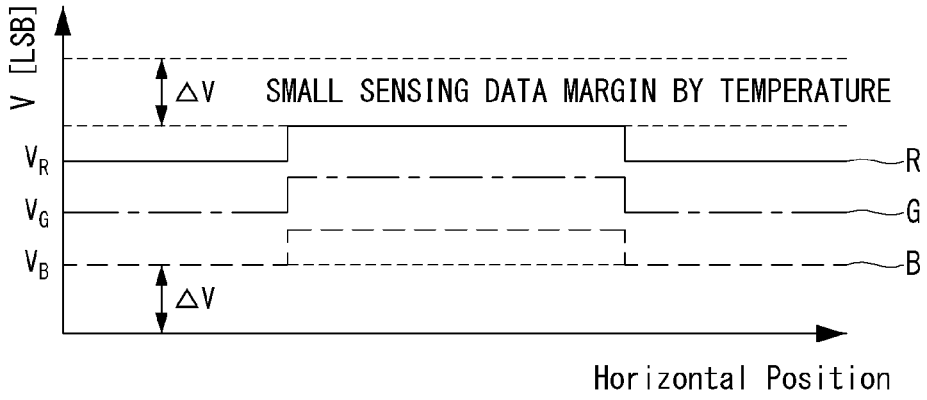
FIG. 15 is a graph showing sensing data margin for explanation of a sensing method according to the second experiment example.
Figure 16:
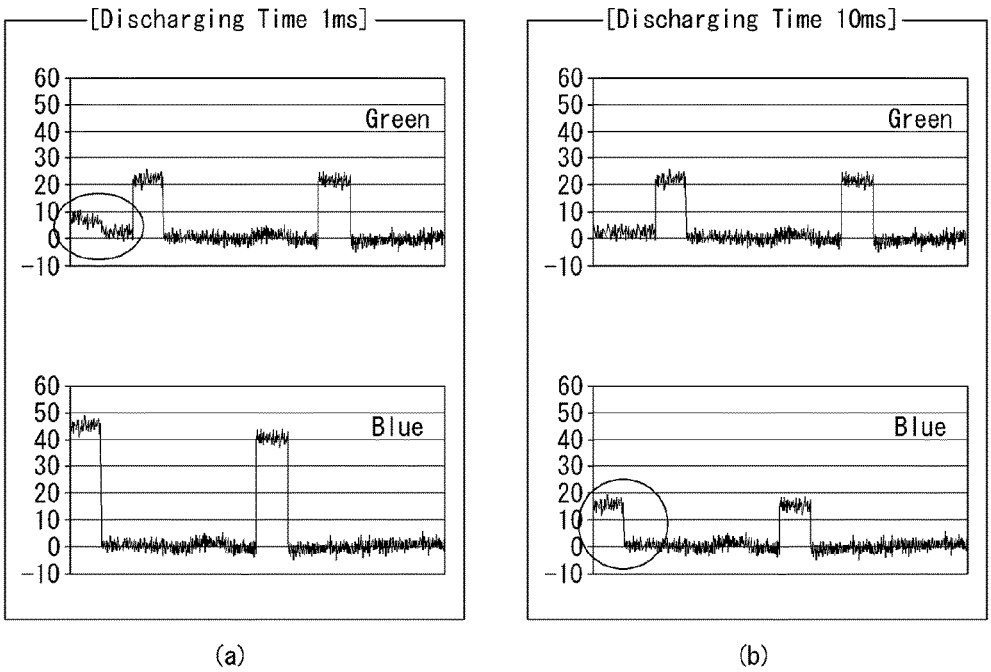
FIG. 16 is a graph for explanation of a reliability problem of a sensing method according to the second experiment example.

FIG. 14 is a charging/discharging curve graph for explanation of a problem of a sensing method according to the second experiment example, FIG. 15 is a graph showing sensing data margin for explanation of a sensing method according to the second experiment example, and FIG. 16 is a graph for explanation of a reliability problem of a sensing method according to the second experiment example.

As illustrated in FIGS. 14 to 16, in the second experiment example, a charging voltage Vpre is applied to an organic light emitting diode for a predetermined time t0 in order to sense the organic light emitting diode. Then, when the organic light emitting diode is discharging, the OLED is sensed with respect to a sensing reference voltage Vavref in accordance with an analog-to-digital conversion (ADC) scale. Accordingly, a data driver senses a degree of deterioration of an organic light emitting diode of each subpixel.

In the second experiment example, a single voltage is used as a charging voltage Vpre. In addition, the same charging voltage Vpre is supplied to a red organic light emitting diode (R), a green organic light emitting diode (G), and a blue organic light emitting diode (B). In this case, the ADC scale is provided by considering sensing variation of the red organic light emitting diode (R), the green organic light emitting diode (G), and the blue organic light emitting diode (B).

In the second experiment example, the same charging voltage Vpre is supplied to all of the red organic light emitting diode (R), the green organic light emitting diode (G), and the blue organic light emitting diode (B), as shown in FIG. 14, and sensing data is obtained from each of the red organic light emitting diode (R), the green organic light emitting diode (G), and the blue organic light emitting diode (B) for the same sensing time after a predetermined time t1. However, sensing data VR, VG, and VB are obtained with variation (VR≠VG≠VB) due to different characteristics of the red organic light emitting diode (R), the green organic light emitting diode (G), and the blue organic light emitting diode (B), It is because an organic light emitting diode has different emission efficiency due to luminance degraded based on a color emitted from the organic light emitting diode, as shown in FIGS. 9A to 9C. In addition, the organic light emitting diode has different deterioration speed based on a color emitted therefrom, as shown in FIG. 10. In addition, it is because emission efficiency and deterioration speed are different according to luminance. Therefore, even though the red organic light emitting diode (R), the green organic light emitting diode (G), and the blue organic light emitting diode (B) are sensed after the same time t1, there may be variation (VR≠VG≠VB) in sensing data, as shown in FIG. 15.

In addition, in the second experiment example, a sensing variation range set in the ADC scale is wide, but there is a lack of sensing data margin due to sensing variation ΔV by temperature.

This problem happens because a color emitted from an organic light emitting diode determines how much the organic light emitting diode is affected by temperature, as shown in FIG. 16. For example, as shown in (a) of FIG. 16, when the discharging time is 1 ms, sensing data Green of a green organic light emitting diode is affected significantly by temperature (decreasing reliability). On the other hand, as shown in (b) of FIG. 16, when the discharging time is 10 ms, the sensing data Green of the green organic light emitting diode is less affected by temperature (increasing reliability).

The opposite result is obtained in the experiment regarding a blue organic light emitting diode. For example, as shown in (a) of FIG. 16, when the discharging time is 1 ms, sensing data Green of a blue organic light emitting diode is less affected by temperature (increasing reliability). On the other hand, as shown in (b) of FIG. 16, when the discharging time is 10 ms, the sensing data Green of the blue organic light emitting diode is significantly affected by temperature (decreasing reliability.

In the above second experiment example, when a single charging voltage Vpre is used, it is impossible to perform voltage sensing according to characteristics (degree of deterioration, and change caused by aging) of an organic light emitting diode. In addition, if environment change, such as temperature, occurs in the second experiment example, it is difficult to uniformly sense voltage levels of the red organic light emitting diode (R), the green organic light emitting diode (G), and the blue organic light emitting diode (B), and thus, sensing accuracy is reduced.

Second Embodiment

Figure 17:
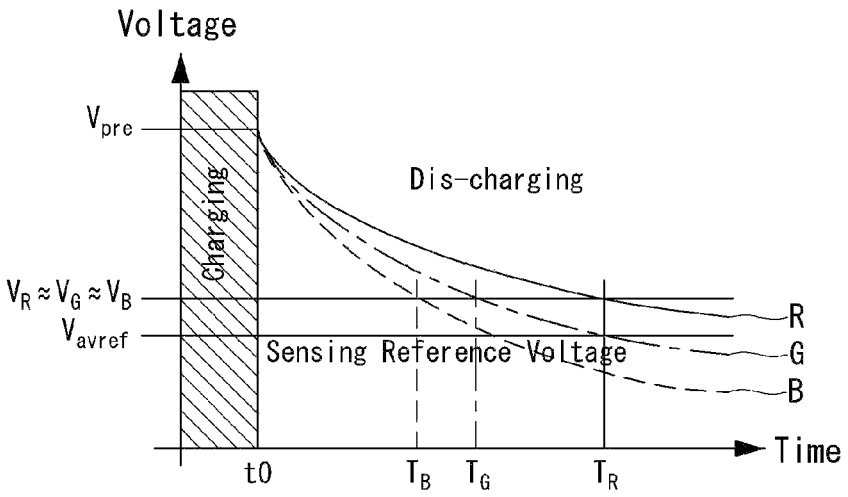
FIG. 17 is a charging/discharging curve graph for explanation of a sensing method according to the second embodiment of the present disclosure.
Figure 18:
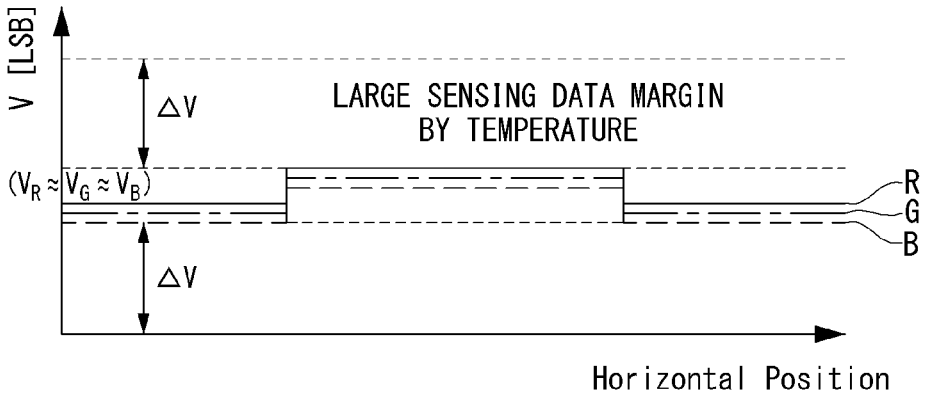
FIG. 18 is a graph showing sensing data margin for explanation of the sensing method according to the second embodiment of the present disclosure.
Figure 19:
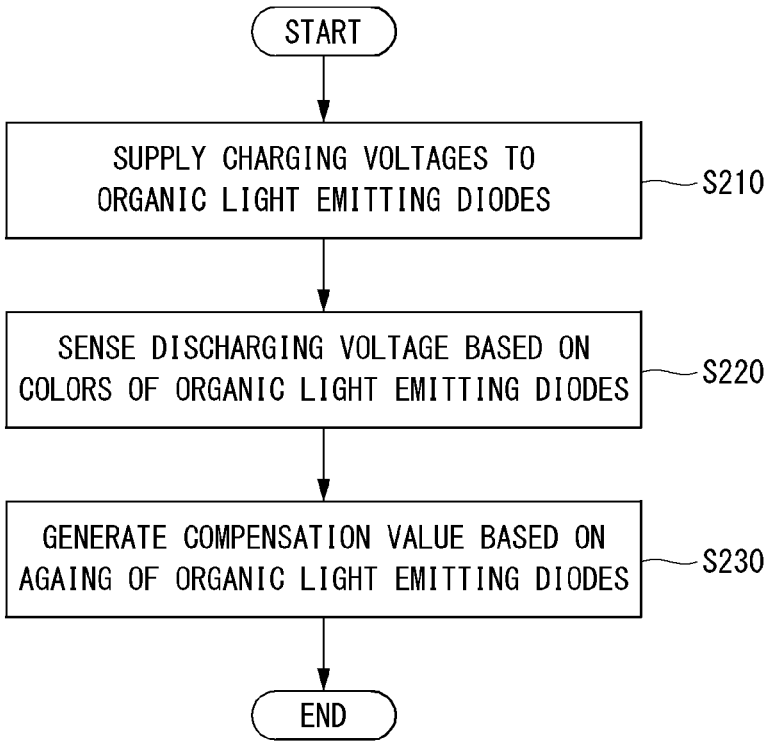
FIG. 19 is a flowchart illustrating the second method according to the second embodiment of the present disclosure.

FIG. 17 is a charging/discharging curve graph for explanation of a sensing method according to the second embodiment of the present disclosure, FIG. 18 is a graph showing sensing data margin for explanation of the sensing method according to the second embodiment of the present disclosure, and FIG. 19 is a flowchart illustrating the second method according to the second embodiment of the present disclosure.

As illustrated in FIGS. 17 and 19, the sensing method according to the second embodiment of the present disclosure uses a different sensing time based on aging characteristics of organic light emitting diodes.

The sensing method according to the second embodiment of the present disclosure includes supplying charging voltages to organic light emitting diodes in S210, sensing discharging voltages of the organic light emitting diodes based on colors emitted therefrom in S220, and generating a compensation value based on aging of the organic light emitting diodes in S230.

In the second embodiment of the present disclosure, a charging voltage Vpre is applied for a predetermined time T0 in order to independently sense an organic light emitting diode (in other words, to obtain the optimal electrical characteristics of each device). A red organic light emitting diode (R), a green organic light emitting diode (G), a blue organic light emitting diode (B) may be all supplied with the same charging voltage, or at least one of them may be supplied with a different charging voltage.

In the second embodiment of the present disclosure, the same charging voltage Vpre is applied to the red organic light emitting diode (R), the green organic light emitting diode (G), and the blue organic light emitting diode (B) for the predetermined time T0, and then the red organic light emitting diode (R), the green organic light emitting diode (G), and the blue organic light emitting diode (B) are discharged. Each of the red organic light emitting diode (R), the green organic light emitting diode (G), and the blue organic light emitting diode (B) has a different discharging curve, and therefore, sensing data is obtained from those organic light emitting diodes for different sensing time TB, TG, or TR.

However, the above example is a case where each organic light emitting diode has different characteristics. Thus, if two organic light emitting diodes have the same characteristics and only one organic light emitting diode has different characteristics, the sensing time may be in a relationship of the second sensing time=the third sensing time<the first sensing time or in a relationship of the second sensing time=the third sensing time>the first sensing time.

As such, if each OLED has an independent sensing discharging time, the sensing data VR, VG, and VG may be sensed similarly as if characteristic variation of the red organic light emitting diode (R), the green organic light emitting diode (G), and the blue organic light emitting diode (B) is removed (VR≈VG≈VB). That is, a sensing voltage is at a level close to that of a sensing reference voltage Vavref.

In addition, in the second embodiment of the present disclosure, sensing data from each of the red organic light emitting diode (R), the green organic light emitting diode (G), and the blue organic light emitting diode (B) is provided in a narrow voltage level range, and thus, a sensing variation range ΔV by temperature is narrow and sensing data margin may be secured. In addition, a sensing voltage range (sensing range) set in the ADC scale may be reduced, and thus, sensing accuracy may improve.

In the above second embodiment of the present disclosure, sensing data from organic light emitting diodes is provided in a narrow voltage level range, and thus, a sensing variation range ΔV is narrow and sensing data margin may be secured. In addition, despite environment change, such as temperature, it is possible to uniformly sense a voltage of each of the red organic light emitting diode (R), the green organic light emitting diode (G), and the blue organic light emitting diode (B). Furthermore, the sensing voltage range (sensing range) may be reduced, thereby improving sensing accuracy.

As disclosed, an embodiment of the present disclosure is capable of improving sensing accuracy by performing sensing independently based on colors emitted from organic light emitting diodes. In addition, an embodiment of the present disclosure is capable of reducing sensing time by performing sensing independently based on colors emitted from organic light emitting diodes. Besides, an embodiment of the present disclosure is capable of performing uniform sensing despite environment change such as temperature. Furthermore, an embodiment of the present disclosure is capable of securing sensing data margin by reducing sensing variation range and sensing voltage range.

What is claimed is:

1. An Organic Light Emitting Display (OLED) comprising:

a plurality of subpixels;

a charging circuit configured to supply charging voltages to organic light emitting diodes included in the plurality of subpixels, wherein a different charging voltage is supplied to at least one of the organic light emitting diodes;

a sensing circuit configured to sense discharging voltages of the organic light emitting diodes, wherein the sensing circuit performs sensing during a period in which discharging voltages of the organic light emitting diodes come to converge; and a data driver configured to supply data signals to data lines of the plurality of subpixels.

2. The OLED device of claim 1, wherein the charging circuit supplies the different charging voltage based on aging characteristics of the organic light emitting diodes included in the plurality of subpixels.

3. The OLED device of claim 1, further comprising a sensing circuit configured to sense discharging voltages of the organic light emitting diodes, wherein the sensing circuit performs independent sensing based on a color emitted from each of the plurality of subpixels.

4. The OLED device of claim 1, further comprising a programmable gamma circuit that supplies a gamma voltage to the data driver, wherein the charging circuit supplies the charging voltage based on a voltage output from the programmable gamma circuit.

5. The OLED device of claim 1, wherein each the plurality of subpixels comprises:

a first capacitor;

the organic light emitting diode;

a first switching transistor has a gate electrode connected to a first scan line, a first electrode connected to a data line, and a second electrode connected to one end of the capacitor;

a second switching transistor has a gate electrode connected to a second scan line, a first electrode connected to an anode of the organic light emitting diode, and a second electrode connected to a sensing line; and a driving transistor has a gate electrode connected to the other end of the capacitor, a first electrode connected to a first power line, and a second electrode connected to the first electrode of the second switching transistor.

6. The OLED device of claim 5, further comprising a compensation circuit, wherein the compensation circuit comprises:

a first transistor having a gate electrode connected to a first selection signal line, a first electrode connected to a channel of the data driver, and a second electrode connected to the sensing line;

a second transistor having a gate electrode connected to a second selection signal line, a first electrode connected to the channel of the data driver, and a second electrode connected to the data line; and a second capacitor storing and discharging the charging voltage, wherein one end of the second capacitor connected to the sensing line and the other end of the capacitor connected to a second power line.

7. The OLED device of claim 6, wherein the first transistor is turned on in response to a first selection signal for sensing characteristics of the driving transistor or the organic light emitting diode, and the second transistor is turned on in response to a second selection signal for supplying a data voltage.

8. An Organic Light Emitting Display (OLED) comprising:

a plurality of subpixels;

a sensing circuit configured to sense discharging voltages of organic light emitting diodes included in the plurality of subpixels, wherein one of the discharging voltages is sensed during a different sensing time; and a data driver configured to supply data signals to data lines of the plurality of subpixels.

9. The OLED device of claim 8, wherein the sensing circuit uses the different sensing time based on aging characteristics of the organic light emitting diodes included in the plurality of subpixels.

10. The OLED device of claim 8, further comprising a charging circuit configured to supply a charging voltage of the organic light emitting diodes, wherein the charging circuit supplies the same charging voltage to the plurality of subpixels, or supplies a different charging voltage to at least one of the plurality of subpixels.

11. A method of driving an Organic Light Emitting Display (OLED), the method comprising:

supplying charging voltages to organic light emitting diodes included in a plurality of subpixels, wherein a different charging voltage is supplied to at least one of the organic light emitting diodes;

sensing the organic light emitting diodes during a period in which discharging voltages of the organic light emitting diodes come to converge; and generating a compensation value based on aging characteristics of the organic light emitting diodes.

12. The method of claim 11, wherein the supplying of the charging voltage comprises supplying a different charging voltage based on the aging characteristics of the organic light emitting diodes.

13. A method of driving an Organic Light Emitting Display (OLED), the method comprising:

supplying charging voltages to organic light emitting diodes included in a plurality of subpixels;

sensing discharging voltages of the organic light emitting diodes, wherein one of the discharging voltages is sensed during a different sensing time; and generating a compensation value based on aging characteristics of the organic light emitting diodes.

14. The method of claim 13, wherein the sensing of the discharging voltages comprises performing sensing for a different sensing time based on the aging characteristics of the organic light emitting diodes.

* * * * *